US006743326B2

(12) United States Patent
Bogrett et al.

(10) Patent No.: US 6,743,326 B2
(45) **Date of Patent: *Jun. 1, 2004**

(54) SINGLE TEAR PRE-CUT INSULATION BLANKET

(75) Inventors: Blake Bogrett, Littleton, CO (US); John Brooks Smith, Littleton, CO (US)

(73) Assignee: Johns Manville International, Inc., Denver, CO (US)

( * ) Notice: Subject to any disclaimer, the term of this patent is extended or adjusted under 35 U.S.C. 154(b) by 25 days.

This patent is subject to a terminal disclaimer.

(21) Appl. No.: 10/097,293

(22) Filed: Mar. 14, 2002

(65) Prior Publication Data

US 2003/0175466 A1 Sep. 18, 2003

(51) Int. Cl.[7] ..... B32B 31/18

(52) U.S. Cl. ..... 156/268; 428/43; 428/136; 156/271; 83/879; 52/407.3; 52/407.4; 52/98; 52/742.12; 52/745.19

(58) Field of Search ..... 428/43, 136; 156/268, 156/271; 83/879; 52/407.3, 407.4, 98, 742.12, 745.19

(56) References Cited

U.S. PATENT DOCUMENTS

| | | | | | |
|---|---|---|---|---|---|
| 2,335,968 | A | | 12/1943 | Sawtell | |
| 4,397,898 | A | * | 8/1983 | Ray, Jr. | 428/43 |
| 4,756,945 | A | | 7/1988 | Gibb | |
| 4,866,905 | A | | 9/1989 | Bihy et al. | |
| 5,331,787 | A | | 7/1994 | Paulitschke | |
| 5,545,453 | A | | 8/1996 | Grant | |
| 5,567,504 | A | | 10/1996 | Schakel | |
| 5,765,318 | A | * | 6/1998 | Michelsen | 52/98 |
| 5,817,387 | A | * | 10/1998 | Allwein et al. | 428/43 |
| 6,042,911 | A | * | 3/2000 | Berdan, II | 428/36.3 |
| 6,083,594 | A | | 7/2000 | Weinstein | |
| 6,128,884 | A | | 10/2000 | Berdan, II | |
| 6,165,305 | A | | 12/2000 | Weinstein | |
| 6,383,594 | B2 | * | 5/2002 | Weinstein et al. | 428/43 |
| 6,468,615 | B2 | * | 10/2002 | Weinstein et al. | 428/43 |
| 6,484,463 | B1 | * | 11/2002 | Fay | 52/404.4 |
| 6,551,677 | B2 | * | 4/2003 | Weinstein et al. | 428/43 |
| 2001/0030018 | A1 | * | 10/2001 | Weinstein et al. | 156/257 |
| 2002/0015814 | A1 | * | 2/2002 | Weinstein et al. | 428/43 |
| 2002/0136854 | A1 | * | 9/2002 | Smith et al. | 428/43 |

FOREIGN PATENT DOCUMENTS

| | | | |
|---|---|---|---|
| DE | 7830852 | U1 | 1/1979 |
| DE | 3118597 | A1 | 5/1981 |
| DE | 3203624 | A1 | 4/1983 |
| DE | 3229601 | A1 | 2/1984 |
| DE | 19700373 | A1 | 2/1998 |
| DE | 29822362 | U1 | 5/1999 |
| DE | 19914782 | A1 | 10/2000 |
| WO | WO 97/01060 | A * | 1/1997 |

* cited by examiner

*Primary Examiner*—William P. Watkins, III
(74) *Attorney, Agent, or Firm*—Robert D. Touslee

(57) ABSTRACT

A pre-cut resilient fibrous insulation blanket includes a plurality of longitudinally extending blanket sections that are formed in the blanket by a plurality of laterally spaced apart cut and separable connector arrangements that hold the insulation blanket together for handling but enable the insulation blanket to be separated at any of the cut and separable connector arrangements to form a reduced width resilient fibrous insulation blanket. The number and widths of the blanket sections together with the lateral compressibility and resilience of the insulation blanket or a reduced width insulation blanket formed from the insulation blanket enable the insulation of essentially any width framework cavity up to the width of the insulation blanket with no more than one separation of the insulation blanket.

8 Claims, 7 Drawing Sheets

15" WIDE BATT, 3 CUTS, 4 SECTIONS

| PIECE SIZE | FITS CAVITIES |
|---|---|
| 2-1/2" | UP TO 2-1/2" |
| 4-1/2" | 2-1/2" TO 4-1/2" |
| 6-1/2" | 4-1/2" TO 6-1/2" |
| 8-1/2" | 6-1/2" TO 8-1/2" |
| 10-1/2" | 8-1/2" TO 10-1/2" |
| 12-1/2" | 10-1/2" TO 12-1/2" |

SLIT CONFIGURATION

SECTION WIDTHS - 15" WIDE BATT, 4 SECTIONS

| | | | |
|---|---|---|---|
| 2.5" | 4.0" | 4.0" | 4.5" |

| SINGLE TEAR SIZES | SIZE INCREMENT |
|---|---|
| 2.5" | 2.5" |
| 4.5" | 2.0" |
| 6.5" | 2.0" |
| 8.5" | 2.0" |
| 10.5" | 2.0" |
| 12.5" | 2.0" |

NUMBER OF SINGLE TEAR SIZES 6

LATERAL (SIDE) COMPRESSION

| | |
|---|---|
| **MAXIMUM** | 2.5" |
| **MOST SECTIONS** | 2.0" |

15" WIDE BATT, 3 CUTS, 4 SECTIONS

| PIECE SIZE | FITS CAVITIES |
|---|---|
| 2-3/4" | UP TO 2-3/4" |
| 4-3/4" | 2-3/4" TO 4-3/4" |
| 6-3/4" | 4-3/4" TO 6-3/4" |
| 8-3/4" | 6-3/4" TO 8-3/4" |
| 10-3/4" | 8-3/4" TO 10-3/4" |
| 12-3/4" | 10-3/4" TO 12-3/4" |

SLIT CONFIGURATION

SECTION WIDTHS - 15" WIDE BATT, 4 SECTIONS

| | | | |
|---|---|---|---|
| 2.75" | 4.0" | 4.0" | 4.75" |

| SINGLE TEAR SIZES | SIZE INCREMENT |
|---|---|
| 2.75" | 2.75" |
| 4.75" | 2.0" |
| 6.75" | 2.0" |
| 8.75" | 2.0" |
| 10.75" | 2.0" |
| 12.75" | 2.0" |

NUMBER OF SINGLE TEAR SIZES 6

LATERAL (SIDE) COMPRESSION

| | |
|---|---|
| **MAXIMUM** | 2.75" |
| **MOST SECTIONS** | 2.0" |

15" WIDE BATT, 4 CUTS, 5 SECTIONS

| PIECE SIZE | FITS CAVITIES |
|---|---|
| 2" | UP TO 2" |
| 3.57" | 2" TO 3.57" |
| 5.14" | 3.57" TO 5.14" |
| 6.71" | 5.14" TO 6.71" |
| 8.29" | 6.71" TO 8.29" |
| 9.86" | 8.29" TO 9.86" |
| 11.43" | 9 .86" TO 11.43" |
| 13.00" | 11.43" TO 13.00" |

SLIT CONFIGURATION

SECTION WIDTHS - 15" WIDE BATT, 5 SECTIONS

| | | | | |
|---|---|---|---|---|
| 2.00" | 3.14" | 3.14" | 3.14" | 3.58" |

| SINGLE TEAR SIZES | SIZE INCREMENT |
|---|---|
| 2.00" | 2.00" |
| 3.57" | 1.57" |
| 5.14" | 1.57" |
| 6.71" | 1.57" |
| 8.29" | 1.57" |
| 9.86" | 1.57" |
| 11.43" | 1.57" |
| 13.00" | 1.57" |

NUMBER OF SINGLE TEAR SIZES 8

LATERAL (SIDE) COMPRESSION

| | |
|---|---|
| **MAXIMUM** | 2.00" |
| **MOST SECTIONS** | 1.57" |

15" WIDE BATT, 4 CUTS, 5 SECTIONS

| PIECE SIZE | FITS CAVITIES |
|---|---|
| 1.66" | UP TO 1.66" |
| 3.33" | 1.66" TO 3.33" |
| 5.00" | 3.33" TO 5.00" |
| 6.66" | 5.00" TO 6.66" |
| 8.33" | 6.66" TO 8.33" |
| 10.00" | 8.33" TO 10.00" |
| 11.66" | 10.00" TO 11.66" |
| 13.33" | 11.66" TO 13.33" |

SLIT CONFIGURATION

SECTION WIDTHS - 15" WIDE BATT, 5 SECTIONS

| | | | | |
|---|---|---|---|---|
| 1.66" | 3.33" | 3.33" | 3.33" | 3.33" |

| SINGLE TEAR SIZES | SIZE INCREMENT |
|---|---|
| 1.66" | 1.66" |
| 3.33" | 1.66" |
| 5.00" | 1.66" |
| 6.66" | 1.66" |
| 8.33" | 1.66" |
| 10.00" | 1.66" |
| 11.66" | 1.66" |
| 13.33" | 1.66" |

NUMBER OF SINGLE TEAR SIZES 8

LATERAL (SIDE) COMPRESSION

| | |
|---|---|
| **MAXIMUM** | 1.66" |
| **MOST SECTIONS** | 1.66" |

15" WIDE BATT, 3 CUTS, 4 SECTIONS

| PIECE SIZE | FITS CAVITIES |
|---|---|
| 2.14" | UP TO 2" |
| 4.29" | 2.14" TO 4.29" |
| 6.43" | 4.29" TO 6.43" |
| 8.57" | 6.43" TO 8.57" |
| 10.71" | 8.57" TO 10.71" |
| 12.86" | 10.71" TO 12.86" |

SLIT CONFIGURATION

SECTION WIDTHS - 15" WIDE BATT, 4 SECTIONS

| | | | | |
|---|---|---|---|---|
| 2.14" | 4.29" | 4.29" | 4.29" | 4.29" |

| SINGLE TEAR SIZES | SIZE INCREMENT |
|---|---|
| 2.14" | 2.14" |
| 4.29" | 2.14" |
| 6.43" | 2.14" |
| 8.57" | 2.14" |
| 10.71" | 2.14" |
| 12.86" | 2.14" |

NUMBER OF SINGLE TEAR SIZES 6

LATERAL (SIDE) COMPRESSION

| | |
|---|---|
| **MAXIMUM** | 2.14" |
| **MOST SECTIONS** | 2.14" |

SINGLE TEAR PRE-CUT INSULATION BLANKET

BACKGROUND OF THE INVENTION

The subject invention relates to a pre-cut resilient fibrous insulation blanket of longitudinally extending blanket sections that can be used as a unit or separated by hand intermediate any of its blanket sections to form a reduced width resilient fibrous insulation blanket. More specifically, the subject invention relates to a pre-cut resilient fibrous insulation blanket which can be used to insulate any width cavity up to the width of the insulation blanket with no more than one separation of the insulation blanket at one of the blanket sections and to a method of determining the widths of the blanket sections for such a pre-cut resilient fibrous insulation blanket that will enable the use of fewest number of blanket sections.

A pre-cut resilient fibrous insulation blanket, from which one or more longitudinally extending blanket sections can be selectively separated by hand to form a reduced width resilient fibrous insulation blanket, enables the formation of such a reduced width resilient fibrous insulation blanket without the need to cut the insulation blanket in the field thereby reducing installation time and avoiding potential injuries due to the use of cutting implements in the field. However, to facilitate the rapid insulation of cavities of various non-standard widths, it would be desirable to be able to selectively form a reduced width resilient fibrous insulation blanket to fit essentially any non-standard cavity width with no more than one separation or longitudinal tear of the full width pre-cut resilient fibrous insulation blanket.

If the sizing of a reduced width resilient fibrous insulation blanket to fit a nonstandard width cavity requires multiple separations or longitudinal tears of the full width pre-cut resilient fibrous insulation blanket, there are two adverse results. First, instead of having one relatively large blanket portion remaining after the reduced width resilient fibrous insulation blanket has been formed, there are two relatively smaller blanket portions remaining. A relatively larger blanket portion can be subsequently used to insulate a relatively large width non-standard cavity or later separated, if needed, to insulate two smaller width non-standard cavities while as a practical matter two smaller width blanket portions can be used only to insulate small width non-standard cavities. Cavity size statistics for homes and similar residential structures indicate that multiple blanket separations would produce more of the smaller blanket portions than there are small cavities to insulate in these structures thereby resulting in scrap and waste. Second, a pre-cut resilient fibrous insulation blanket that can be formed into a reduced width resilient fibrous blanket by separating the full width pre-cut resilient fibrous insulation blanket by hand intermediate blanket sections saves the installer time by eliminating the need to cut a full width resilient fibrous insulation blanket lengthwise, e.g. about 8 feet, in the field by hand. However, if the installer must separate the full width pre-cut resilient fibrous insulation blanket in two places rather than one to form a reduced width resilient fibrous insulation blanket of a desired width, thereby making two tears in the pre-cut resilient fibrous insulation blanket rather than one, the time savings associated with the use of the pre-cut resilient fibrous insulation blanket over cutting a regular uncut resilient fibrous insulation blanket in the field is reduced.

SUMMARY OF THE INVENTION

The subject invention solves the above-discussed problems associated with the sizing of reduced width resilient fibrous insulation blankets formed from full width pre-cut resilient fibrous insulation blankets and enables the pre-cut resilient fibrous insulation blanket of the subject invention to be used to insulate any size cavity up to the width of the pre-cut resilient fibrous insulation blanket with no more than one separation or longitudinal tear of the pre-cut resilient fibrous insulation blanket. The pre-cut resilient fibrous insulation blanket of the subject invention includes a plurality of longitudinally extending blanket sections that are formed in the blanket by a plurality of laterally spaced apart cut and separable connector arrangements that hold the insulation blanket together for handling and installation but enable the insulation blanket to be separated at any of the cut and separable connector arrangements to form a reduced width resilient fibrous insulation blanket. In the precut resilient fibrous insulation blanket of the subject invention, the number and widths of the blanket sections together with the lateral compressibility and resilience of the pre-cut resilient fibrous insulation blanket or a reduced width resilient fibrous insulation blanket formed from the full width pre-cut resilient fibrous insulation blanket enable the insulation of any width framework cavity up to the width of the full width pre-cut resilient fibrous insulation blanket with no more than one separation or longitudinal tear of the full width pre-cut resilient fibrous insulation blanket.

Standard framework construction for exterior and interior walls in homes and other residential structures locate the nominally 2×4 or 2×6 inch studs on 16 or 24 inch centers. Accordingly, the widths of the standard size wall cavities in home and other residential structures are 14½ inches and 22½ inches respectively. To assure a compressive fit within these standard size wall cavities residential building insulation is made in two nominal widths of 15 inches (the width typically ranges from 15 inches to 15½ inches) and 23 inches (the width typically ranges from 23 inches to 23½ inches). The pre-cut resilient fibrous insulation blanket of the subject invention is primarily intended to insulate cavities having widths from about ¾ of an inch up to substantially the full width of the pre-cut resilient fibrous insulation blanket. Cavities less than about ¾ of an inch in width are normally insulated in a process called chinking by inserting scrap insulation into the cavities with a screwdriver or similar implement. While a lateral blanket section of the pre-cut resilient insulation blanket of the subject invention could be torn from the pre-cut resilient fibrous insulation blanket specifically for insulating such a cavity, normally the pre-cut resilient fibrous insulation blanket of the subject invention is used for insulating cavities having widths between ¾ of an inch and the standard cavity width and the cavities of less than ¾ of an inch are insulated with scrap.

The subject invention also includes methods for determining the fewest number of and the widths for the blanket sections required to provide a pre-cut resilient fibrous insulation blanket that can be used to insulate cavities having any width up to substantially the full width of the pre-cut resilient fibrous insulation blanket with no more than one separation or longitudinal tear of the pre-cut resilient fibrous insulation blanket. The methods take into account a selected maximum lateral compression desired for the pre-cut resilient fibrous insulation blanket or a reduced width resilient fibrous insulation blanket formed from the pre-cut resilient fibrous insulation blanket. Criteria that may be used to identify the nominal maximum desired lateral compression for the full width pre-cut or reduced width resilient fibrous insulation blanket are the amount of lateral compression that can be sustained by the pre-cut resilient fibrous insulation blanket or a reduced width resilient fibrous insulation blanket made from the pre-cut resilient fibrous insulation blanket without appreciably adversely affecting the thermal performance and/or the resilience of the insulation blanket.

DESCRIPTION OF THE PREFERRED EMBODIMENT

Figure 1:
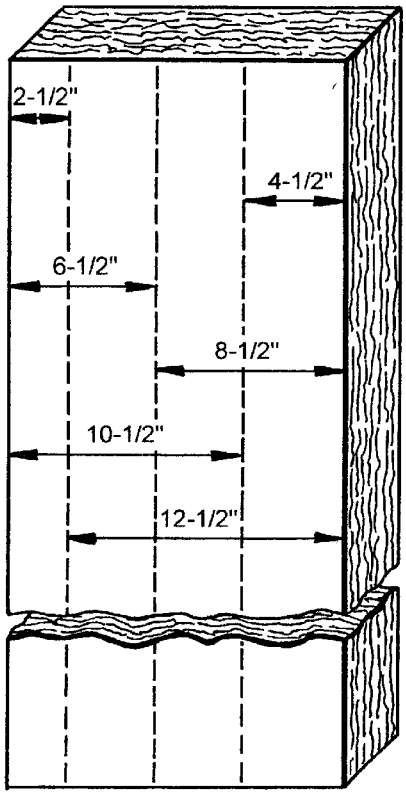
FIGS. 1 to 5 are diagrams of five different pre-cut resilient fibrous insulation blankets of the subject invention illustrating different size reduced width resilient fibrous insulation blankets that can be formed from the pre-cut resilient fibrous insulation blankets of the subject invention by separating or tearing the pre-cut resilient fibrous insulation blankets no more than once.

While the faced and unfaced pre-cut resilient fibrous insulation blankets of the subject invention may be made of other fibrous materials, preferably, the unfaced and faced pre-cut resilient fibrous insulation blankets of the subject invention are made of randomly oriented, entangled, glass fibers and typically have a density between about 0.3 pounds/ft$^3$ and about 1.6 pounds/ft$^3$. The fibrous insulation materials used to form the pre-cut resilient fibrous insulation blankets of the subject invention, whether made of glass or other fibers, are sufficiently resilient to close longitudinally extending cuts (partial cuts) and, if used, transversely extending cuts (partial cuts) made in the fibrous insulation blanket that both: a) divide the blanket into longitudinally extending blanket sections of selected widths and lengths; and b) by not completely severing the blanket between adjacent blanket sections, form separable connectors within the blanket separably joining adjacent blanket sections. With this structure, the cuts in the pre-cut resilient fibrous insulation blankets of the subject invention do not form thermal bridges in the direction of the thickness of the blanket (perpendicular to the major surfaces of the blanket) that would adversely affect the thermal and/or acoustical performance or other properties of the pre-cut resilient fibrous insulation blanket. Where the blanket sections are formed in the precut resilient fibrous insulation blanket of the subject invention by cuts that completely sever the blanket between adjacent blanket sections and the separable connectors separably joining adjacent blanket sections of the pre-cut resilient fibrous insulation blanket are formed from a facing sheet or sheets bonded to one or both of the major surfaces of the blanket or an adhesive between abutting sides of the blanket sections that separably join the adjacent blanket sections together, the resilience of the precut resilient fibrous insulation blanket also helps to prevent the formation of thermal bridges within the blanket in the direction of the thickness of the blanket. Examples of other fibers that may be used to form the unfaced and faced pre-cut resilient insulation blankets of the subject invention are mineral fibers, such as but not limited to, rock wool fibers, slag fibers, and basalt fibers, and organic fibers such as but not limited to polypropylene, polyester and other polymeric fibers. The fibers in the pre-cut unfaced and faced resilient insulation blankets of the subject invention may be bonded together for increased integrity, e.g. by a binder at their points of intersection such as but not limited to urea phenol formaldehyde or other suitable bonding materials, or the unfaced and faced pre-cut resilient fibrous insulation blankets of the subject invention may be binder-less provided the blankets possess the required integrity and resilience.

Due to their resilience, the unfaced and faced, pre-cut resilient fibrous insulation blankets of the subject invention can be compressed to reduce the blankets in thickness for packaging. When the pre-cut resilient fibrous insulation blankets are removed from the insulation package, the blankets recover to substantially their pre-compressed thickness. However, the resilience of the pre-cut resilient fibrous insulation blankets provides another very important benefit. After a full width pre-cut resilient fibrous insulation blanket or a reduced width resilient fibrous insulation blanket formed from the full width pre-cut resilient fibrous insulation blanket is compressed in width and inserted into a cavity having a width somewhat less than the width of the full width pre-cut resilient fibrous insulation blanket or reduced width resilient fibrous insulation blanket, the full width pre-cut resilient fibrous insulation blanket or reduced width resilient fibrous insulation blanket will expand laterally to the width of the cavity and press against the sides of the cavity to hold or help hold the pre-cut resilient fibrous insulation blanket or reduced width resilient fibrous insulation blanket in place.

Full width pre-cut resilient glass fiber insulation blankets and reduced width resilient glass fiber insulation blankets of the subject invention having a density between about 0.3 pcf to about 1.6 pcf can be compressed laterally up to 3 inches and will expand laterally to resiliently engage the sidewalls of cavity. The full width pre-cut resilient glass fiber insulation blankets and reduced width resilient glass fiber insulation blankets of the subject invention having a density between about 0.3 pcf to about 1.0 pcf can be compressed laterally up to between 2.0 and 3.0 inches without appreciably adversely affecting the thermal performance and/or resilience of the insulation blanket. However, the higher density full width pre-cut resilient glass fiber insulation blankets and reduced width resilient glass fiber insulation blankets of the subject invention having a density between about 1.0 pcf and about 1.6 pcf may exhibit some reduction in thermal performance and/or resilience when compressed laterally a distance greater than 1 to 2 inches.

While the unfaced and faced pre-cut resilient fibrous insulation blankets of the subject invention may be in roll form (typically in excess of 117 inches in length), for most applications, such as the insulation of walls in homes and other residential structures, the unfaced or faced pre-cut resilient fibrous insulation blankets of the subject invention are in the form of batts about 46 to about 59 inches in length (typically about 48 inches in length) or 88 to about 117 inches in length (typically about 93 inches in length). Typically, the widths of the unfaced and faced pre-cut resilient fibrous insulation blankets are substantially equal to or somewhat greater than standard cavity width of the cavities to be insulated, for example: about 15 to about 15½ inches in width (a nominal width of 15 inches) for a cavity where the center to center spacing of the wall, floor, ceiling or roof framing members is about 16 inches (the cavity having a width of about 14½ inches); and about 23 to about 23½ inches in width (a nominal width of 23 inches) for a cavity where the center to center spacing of the wall, floor, ceiling or roof framing members is about 24 inches (the cavity having a width of about 22½ inches). However, for other applications, the precut resilient fibrous insulation blankets may have different initial widths determined by the standard widths of the cavities to be insulated by the insulation blankets.

The thicknesses of the unfaced and faced pre-cut resilient fibrous insulation blankets of the subject invention are determined by the amount of thermal resistance or sound control desired and the depth of the cavities being insulated. Typically, the unfaced and faced pre-cut resilient fibrous insulation blankets are about three to about ten or more inches in thickness and approximate the depth of the cavities being insulated. For example, in a wall cavity defined in part by nominally 2×4 or 2×6 inch studs or framing members, a pre-cut resilient fibrous insulation blanket will have a thickness of about 3 ½ inches or about 5 ½ inches, respectively.

The preferred pre-cut resilient fibrous insulation blanket of the subject invention includes a plurality of longitudinally extending blanket sections formed in the resilient fibrous insulation blanket by a plurality of longitudinally extending cut and separable connector arrangements located intermediate the blanket sections of the resilient fibrous insulation blanket and spaced laterally from each other and laterally inward from the lateral edges of the resilient fibrous insulation blanket. The separable connectors of the cut and separable connector arrangements separably join the adjacent blanket sections of the pre-cut resilient fibrous insulation blanket along the length of the resilient fibrous insulation blanket to hold the resilient fibrous insulation blanket together for handling and installation while being separable by hand to permit selective separation of adjacent blanket sections to form a reduced width resilient fibrous insulation blanket of a desired or selected width.

The blanket sections include first and second lateral (outside) blanket sections adjacent the lateral edges of the pre-cut resilient fibrous insulation blanket and a plurality of intermediate (inside) blanket sections intermediate the first and second lateral blanket sections. The first lateral blanket section has a width of at least ¾ of an inch and preferably a width between 1 inch and 3 inches with the selected width being set by taking into account the maximum lateral compression desired for the full width pre-cut resilient fibrous insulation blanket and any reduced width resilient fibrous insulation blanket formed from the full width pre-cut resilient fibrous insulation blanket. Preferably, the second lateral blanket section has a width that is greater than the width of the first lateral blanket section by a distance about equal to the maximum lateral compression desired for the full width pre-cut resilient fibrous insulation blanket and any reduced width resilient fibrous insulation blanket formed from the full width pre-cut resilient fibrous insulation blanket. Preferably, the intermediate blanket sections are equal or substantially equal in width to each other and in one embodiment of the invention the intermediate blanket sections and the second lateral blanket section have the same or substantially the same widths. In another embodiment of the invention, the nominally 23 inch wide blanket has a cut and separable connector arrangement in about the middle of the blanket. The blanket sections have widths such that, for any non-standard width cavity ranging from about ¾ of an inch to 1 inch in width to a width equal to a smallest width to be compressibly fit and resiliently engaged by the full width pre-cut resilient fibrous insulation blanket, the full width pre-cut resilient fibrous insulation blanket can be selectively separated at one of the cut and separable connector arrangements to form a reduced width resilient fibrous insulation blanket that is laterally compressible at least the selected maximum compressible width and has a width to compressibly fit within and resiliently engage any such non-standard width cavity.

The following is a first method for determining the width of the lateral and intermediate blanket sections that will make a full width pre-cut resilient fibrous insulation blanket capable of insulating any or essentially any width framework cavity up to the width of the full width pre-cut resilient fibrous insulation blanket with no more than one separation or longitudinal tear of the full width pre-cut resilient fibrous insulation blanket at one of the cut and separable connector assemblies. The method involves the use of the following equations:

$$W=L_1+L_2+(N-2)A$$

$$I=L_2-L_1$$

$$A=(L_2-L_1)2$$

where:

W=total width of the pre-cut resilient fibrous insulation blanket $L_1$=the nominal maximum desired lateral compression distance and the width of a first lateral blanket section $L_2$=the width of a second lateral blanket section N=the total number of blanket sections I=the difference between $L_2$ and $L_1$ or $L_2-L_1$ A=the width of each intermediate section First, the width W of the insulation blanket to be formed into a pre-cut resilient fibrous insulation blanket is selected, e.g. a blanket with a nominal 15 or nominal 23 inch width. Second, a nominal maximum desired compression distance $L_1$ for the pre-cut resilient fibrous insulation blanket or any reduced width resilient fibrous insulation blanket formed from the pre-cut resilient fibrous insulation blanket is selected. Third, a possible number of blanket sections to be formed in the pre-cut resilient fibrous insulation blanket is selected, e.g. 4 or more. Fourth, using the formulas $W=L_1+L_2+(N-2)A$; $A=(L_2-L_1)2$; and $I=L_2-L_1$ determine the value of I which is the difference in width between the lateral blanket sections. Fifth, substituting the value for I for $(L_2-L_1)$ in the equation $A=(L_2-L_1)2$, determine for the value of A which is the width of each intermediate section. Sixth, substituting the value for A in the equation $A=(L_2-L_1)2$; determine the value of $L_2$ which is the width of the second lateral blanket section. As a result of the above procedure, suggested widths for the two lateral blanket sections and the intermediate blanket sections are known and can be used to form a pre-cut resilient fibrous insulation blanket of the subject invention.

Figure 2:
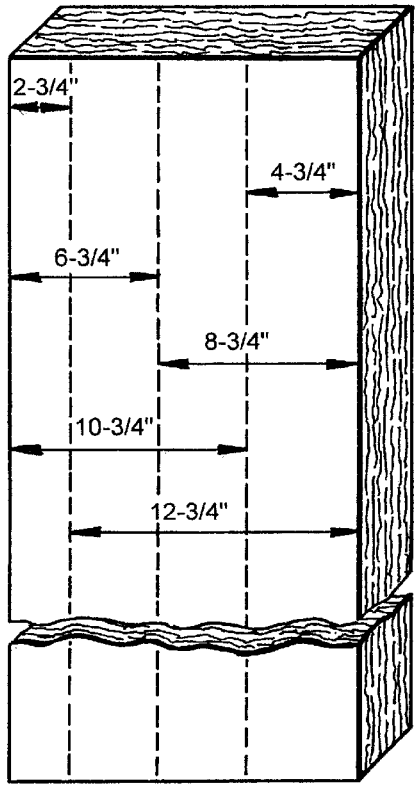
Figure 3:
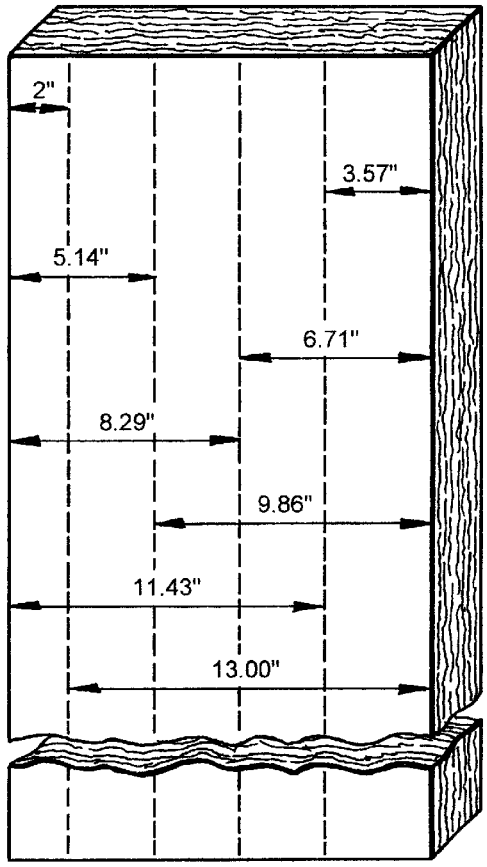

FIGS. 1 to 3 illustrate several pre-cut resilient fibrous insulation blankets wherein, for a selected number of blanket sections, the widths of the lateral and intermediate blanket sections have been determined by using the first method set forth in the preceding paragraph. In FIG. 1, the pre-cut resilient fibrous insulation blanket is 15 inches in width; there are four blanket sections of 2.5 inches, 4 inches, 4 inches, and 4.5 inches that provide six different width single tear reduced width resilient fibrous insulation blankets; and the maximum lateral compression for the pre-cut resilient fibrous insulation blanket or any reduced width resilient fibrous insulation blanket formed from the full width pre-cut resilient fibrous insulation blanket is 2.5 inches with most reduced width resilient fibrous insulation blankets requiring no more than a 2 inch lateral compression to enable the insulation of any cavity width up to the width of the pre-cut resilient fibrous insulation blanket with no more than one separation or longitudinal tear.

If the nominal 15 inch wide pre-cut resilient fibrous insulation blanket is actually 15.5 inches wide, the same method may be used to determine the widths of the lateral and intermediate blanket sections with the extra 0.5 inches being evenly split between the two lateral blanket sections. In FIG. 2, the pre-cut resilient fibrous insulation blanket is 15.5 inches in width; with the extra 0.5 inches being equally split between the two lateral blanket sections, there are four blanket sections of 2.75 inches, 4 inches, 4 inches, and 4.75 inches that provide six different width single tear reduced width resilient fibrous insulation blankets; and the maximum lateral compression for the pre-cut resilient fibrous insulation blanket or any reduced width resilient fibrous insulation blanket formed from the full width pre-cut resilient fibrous insulation blanket is 2.75 inches with most reduced width resilient fibrous insulation blankets requiring no more than a 2 inch lateral compression to enable the insulation of any cavity width up to the width of the pre-cut resilient fibrous insulation blanket with no more than one separation or longitudinal tear.

If it is desired to form five blanket sections in a nominal 15 inch wide pre-cut resilient fibrous insulation blanket rather than four, the same method may be used to determine the widths of the lateral and intermediate blanket sections. In FIG. 3, the pre-cut resilient fibrous insulation blanket is 15 inches in width; there are five blanket sections of 2.00 inches, 3.14 inches, 3.14 inches, 3.14 inches, and 3.58 inches that provide eight different width single tear reduced width resilient fibrous insulation blankets; and the maximum lateral compression for the pre-cut resilient fibrous insulation blanket or any reduced width resilient fibrous insulation blanket formed from the full width pre-cut resilient fibrous insulation blanket is 2.00 inches with most reduced width resilient fibrous insulation blankets requiring no more than a 1.67 inch lateral compression to enable the insulation of any cavity width up to the width of the pre-cut resilient fibrous insulation blanket with no more than one separation or longitudinal tear.

The following is a second method for determining the width of the lateral and intermediate blanket sections that will make a full width pre-cut resilient fibrous insulation blanket capable of insulating any or essentially any width framework cavity up to the width of the full width pre-cut resilient fibrous insulation blanket with no more than one separation or longitudinal tear of the full width pre-cut resilient fibrous insulation blanket at one of the cut and separable connector assemblies. When using this method, a first lateral blanket section has a first width and the other blanket sections including the second lateral blanket section have a second width. The method involves the use of the following procedure. First select a blanket width W. Second, identify a nominal or approximate maximum desired lateral compression distance D. Third, divide the maximum desired lateral compression distance D into the blanket width W to obtain a number. Fourth, round the number obtained by dividing D into W up to the nearest higher odd integer and divide the nearest higher odd integer into the width W of the resilient fibrous insulation blanket to obtain a first possible width for the first lateral blanket section of the resilient fibrous insulation blanket that is less than distance D. Fifth, multiply the first possible width for the first lateral blanket section by 2 to obtain a first possible width for each of the additional blanket sections of the resilient fibrous insulation blanket. Sixth, round the number obtained by dividing D into W down to the nearest lower odd integer and divide the nearest lower odd integer into the width W of the resilient fibrous insulation blanket to obtain a second possible width for the first lateral blanket section of the resilient fibrous insulation blanket that is greater than the distance D. Seventh, multiply the second possible width for the first lateral blanket section by 2 to obtain a second possible width for each of the additional blanket sections of the resilient fibrous insulation blanket. Compare the first possible widths for the first lateral blanket section and each of the additional blanket sections with the second possible widths for the first lateral blanket section and each of the additional blanket sections and select the widths for the first lateral blanket section and the additional blanket sections best suited for the insulating application. If the first possible widths are selected for the blanket sections of the resilient fibrous insulation blanket, the maximum lateral compression for any of the sections will be less than D. If the second possible widths are selected for the blanket sections of the resilient fibrous insulation blanket, the maximum lateral compression for any of the sections will be greater than D.

Figure 4:
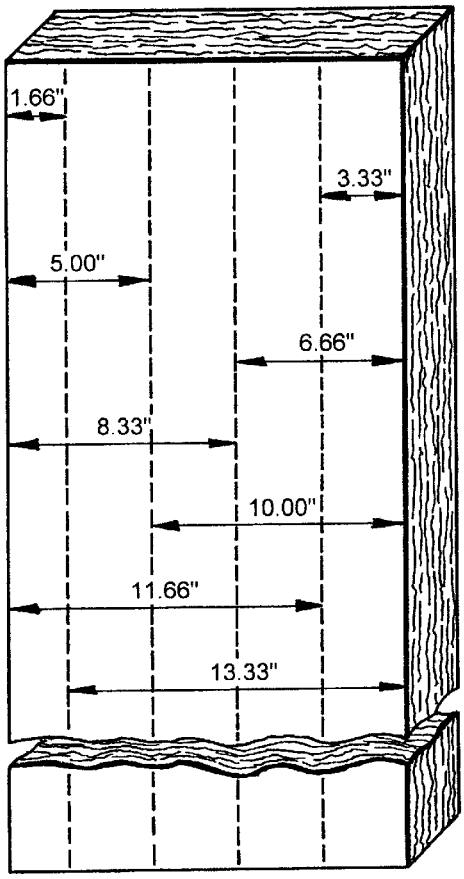
Figure 5:
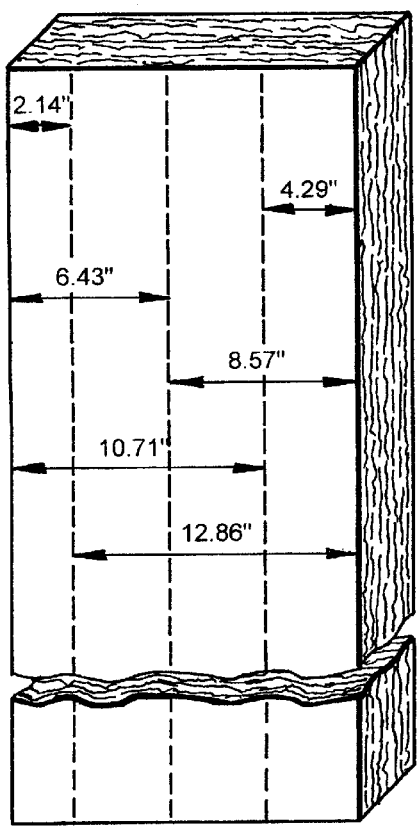

FIGS. 4 and 5 illustrate two pre-cut resilient fibrous insulation blankets wherein the widths of the first lateral blanket section and the additional blanket sections (including the second lateral blanket section) have been determined by using the method set forth in the preceding paragraph. The blanket width W selected is 15 inches and nominal maximum lateral compression D desired for the blanket is 2 inches.

In FIG. 4 the widths of blanket sections were determined by rounding the number obtained by dividing D into W up to the nearest odd integer. There is one lateral blanket section 1.67 inches in width and four blanket sections that are each 3.33 inches in width. This sizing of the blanket sections provides eight different width single tear reduced width resilient fibrous insulation blankets. The maximum lateral compression required for the pre-cut resilient fibrous insulation blanket or any reduced width resilient fibrous insulation blanket formed from the full width pre-cut resilient fibrous insulation blanket to insulate any cavity width up to the width of the pre-cut resilient fibrous insulation blanket with no more than one separation or longitudinal tear is 1.67 inches.

In FIG. 5 the widths of blanket sections were determined by rounding the number obtained by dividing D into W down to the nearest odd integer. There is one lateral blanket section 2.14 inches in width and three blanket sections that are each 4.28 inches in width. This sizing of the blanket sections provides six different width single tear reduced width resilient fibrous insulation blankets. The maximum lateral compression required for the pre-cut resilient fibrous insulation blanket or any reduced width resilient fibrous insulation blanket formed from the full width pre-cut resilient fibrous insulation blanket to insulate any cavity width up to the width of the pre-cut resilient fibrous insulation blanket with no more than one separation or longitudinal tear is 2.14 inches.

Thus, the procedure of the second method provides two choices. With the pre-cut resilient fibrous insulation blanket of FIG. 4, the pre-cut resilient fibrous insulation blanket and any reduced width resilient fibrous insulation blanket made from the pre-cut resilient fibrous insulation blanket only have to be compressed a little under 2 inches (1.67 inches) to insulate any cavity width up to the width of the pre-cut resilient fibrous insulation blanket with no more than one separation or longitudinal tear of the pre-cut resilient fibrous insulation blanket. With the pre-cut resilient fibrous insulation blanket of FIG. 5, the pre-cut resilient fibrous insulation blanket and any reduced width resilient fibrous insulation blanket made from the pre-cut resilient fibrous insulation blanket have to be compressed a little more than 2 inches (2.14 inches) to insulate any cavity width up to the width of the pre-cut resilient fibrous insulation blanket with no more than one separation or longitudinal tear of the pre-cut resilient fibrous insulation blanket. A choice between the two pre-cut resilient fibrous insulation blankets may be made based on the insulation application.

Figure 6:
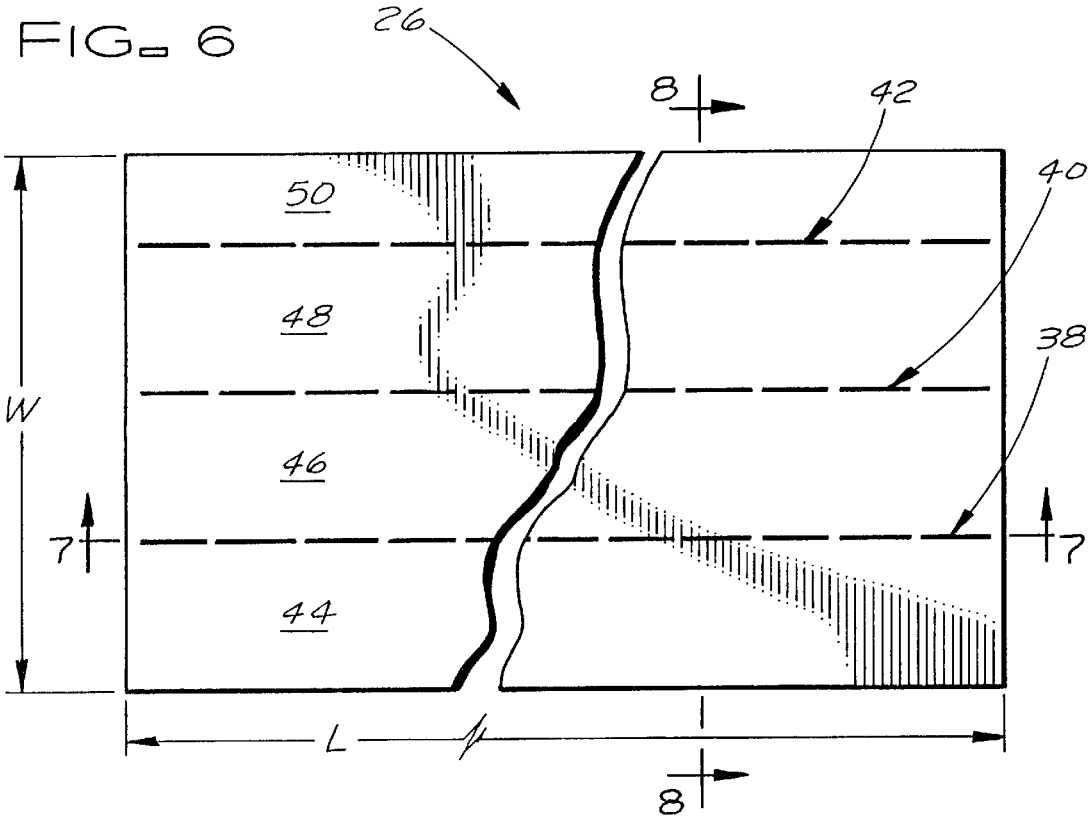
FIG. 6 is a schematic view of a major surface of an unfaced pre-cut resilient fibrous insulation blanket of the subject invention.
Figure 7:
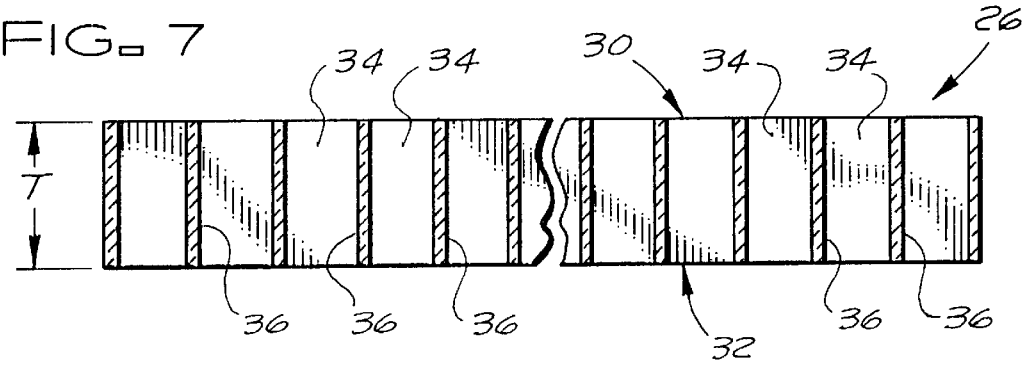
FIG. 7 is a schematic longitudinal cross section of the unfaced pre-cut resilient fibrous insulation blanket of FIG. 6, taken substantially along lines 7—7 of FIG. 6.
Figure 8:
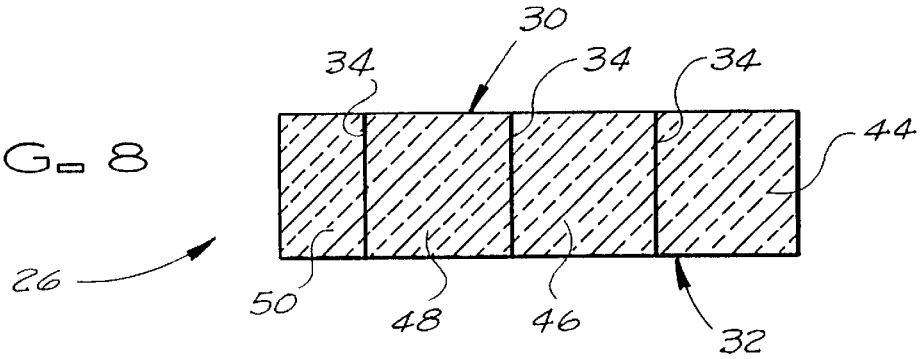
FIG. 8 is a schematic transverse cross section of the unfaced pre-cut resilient fibrous insulation blanket of FIG. 6, taken substantially along lines 8—8 of FIG. 6.

FIGS. 6 to 11 illustrate preferred unfaced and faced pre-cut resilient fibrous insulation blankets of the subject invention. In FIGS. 6 to 8 an unfaced embodiment 26 of the pre-cut resilient fibrous insulation blanket of the subject invention is illustrated. The pre-cut resilient fibrous insulation blanket has a length "L", a width "W" and a thickness "T". A first major surface 30 and a second major surface 32 of the pre-cut resilient fibrous insulation blanket are each defined by the width "W" and the length "L" of the insulation blanket. There are three or more series of cuts 34 and separable connectors 36 (three series 38, 40 and 42 of cuts 34 and separable connectors 36 are shown) which extend for the length of the pre-cut resilient fibrous insulation blanket 26. Each series of cuts 34 and separable connectors 36 divide the pre-cut resilient fibrous insulation blanket into blanket sections with the pre-cut resilient fibrous insulation blanket being divided lengthwise into four or more blanket sections (four blanket sections 44, 46, 48 and 50 are shown) extending the length of the pre-cut resilient fibrous insulation blanket.

Each of the cuts 34 in each series of cuts and separable connectors 38, 40 and 42 extends from the first major surface 30 to the second major surface 32 of the pre-cut resilient fibrous insulation blanket and is separated from preceding and succeeding cuts 34 in its series of cuts and separable connectors by the separable connectors 36. Each of the separable connectors 36 in each series of cuts and separable connectors 38, 40 and 42 may extend from the first major surface 30 to the second major surface 32 of the pre-cut resilient fibrous insulation blanket and is separated from preceding and succeeding separable connectors 36 in its series of cuts and separable connectors by the cuts 34. While each of the separable connectors 36 may extend from the first major surface 30 to the second major surface 32 of the pre-cut resilient fibrous insulation blanket 26 as schematically shown in FIGS. 7 and 8, and, preferably, has a height greater than one half the thickness "T" of the pre-cut resilient fibrous insulation blanket, the connectors 36 may have a height less than one half the thickness of "T" of the pre-cut resilient fibrous insulation blankets. As an example of separable connectors that do not extend from the first major surface 30 to the second major surface 32 of the blanket, the separable connectors 36 might terminate short (e.g. about ⅛ of an inch to about ½ of an inch short) or either or both of the major surfaces 30 and 32. The lengths of the cuts 34 used and the heights and/or lengths of the separable connectors 36 used may vary with the integrity of the pre-cut resilient fibrous insulation blanket with the cuts being shorter and/or the separable connectors being greater in height and/or length for insulation blankets with less integrity.

The fibers of the compressible and resilient fibrous insulation blankets typically used for the pre-cut resilient fibrous insulation blankets, e.g. glass fiber insulation blankets, are randomly oriented with respect to each other, but due to the manner in which the fibers are collected to form the blanket, the fibers tend to lie predominately in layers or planes generally parallel to the major surfaces of the blanket. Thus, adjacent a major surface of the blanket, the blanket may tend to separate more easily along these layers than in a direction perpendicular to the layers when being pulled apart along a series of cuts and separable connectors. By having the separable connectors 36 terminating short of one or both of the major surfaces 30 and 32 of the pre-cut resilient fibrous insulation blanket, there may be less of a tendency for the pre-cut resilient fibrous insulation blanket to partially delaminate adjacent a major surface of the blanket along and adjacent a series of cuts and separable connectors when the blanket is being separated at a series of cuts and separable connectors.

The relative lengths of the cuts 34 and the separable connectors 36 are selected to ensure that the pre-cut resilient fibrous insulation blanket retains the required integrity for handling and to also ensure that the insulation blanket can be easily separated by hand at any of the series of cuts and separable connectors 38, 40 and 42 in the pre-cut resilient fibrous insulation blanket. Generally, the cuts 34 are each about 1 to about 5 inches long and the separable connectors 36 are each about ⅛ to about ½ of an inch long. For example, a typical series of cuts and separable connectors may have cuts about 1 to about 1½ inches long and separable connectors about 3⁄16 to about ¼ of an inch long. The width of the cuts forming the separable connectors 36 in both the faced and the unfaced embodiments of the precut resilient fibrous insulation blanket of the subject invention is typically about four thousands of an inch wide when cut by a water jet or about one hundredth of an inch or less when cut with a compression cutter. The cuts 34 are formed in the pre-cut resilient fibrous insulation blanket 26 so that the resilience of the blanket causes the cuts 34 in the pre-cut resilient fibrous insulation blanket to close after the cuts are made in the blanket to prevent the formation of thermal bridges in the insulation blanket in the direction of the thickness of the blanket.

With the separable connectors 36 of each series of cuts and separable connectors 38, 40 and 42 joining the adjacent blanket sections 44, 46, 48 and 50 of the pre-cut resilient fibrous insulation blanket together, the pre-cut resilient fibrous insulation blanket can be handled as a unit for insulating a cavity having a width about equal to the preselected width of the blanket (e.g. typically, a cavity about ½ of an inch to about 2 to 3 inches less in width) or easily separated or torn apart by hand at one of the series of cuts and separable connectors 38, 40 and 42 formed by the cuts 34 and the separable connectors 36 (separated without the need to use a knife or other cutting tool) into a reduced width resilient fibrous insulation blanket of one or more integral blanket sections 44, 46, 48, and/or 50 for insulating a cavity having a lesser width.

Preferably, for a faced embodiment of the pre-cut resilient fibrous insulation blanket of the subject invention, the facing or facing sheet of the faced pre-cut resilient fibrous insulation blanket 126 is made of kraft paper, a foil-scrim-kraft paper laminate, a foil-kraft laminate, polymeric film-scrim-kraft laminate, a fabric, or a polymeric film, such as but not limited to polyethylene, and is bonded to a major surface of the pre-cut resilient fibrous insulation blanket by a bonding agent. Preferably, the bonding agent for Kraft paper or foil-scrim-Kraft paper facings is an asphalt or other bituminous material that can be coated onto or otherwise applied to one side of the facing sheet just prior to applying the facing sheet to the major surface of the pre-cut resilient fibrous insulation blanket and the bonding agent for the polymeric film facing is a commercially available pressure sensitive adhesive that can be coated onto or otherwise applied to one side of the facing sheet just prior to applying the facing sheet to a major surface of the pre-cut resilient fibrous insulation blanket.

Figure 9:
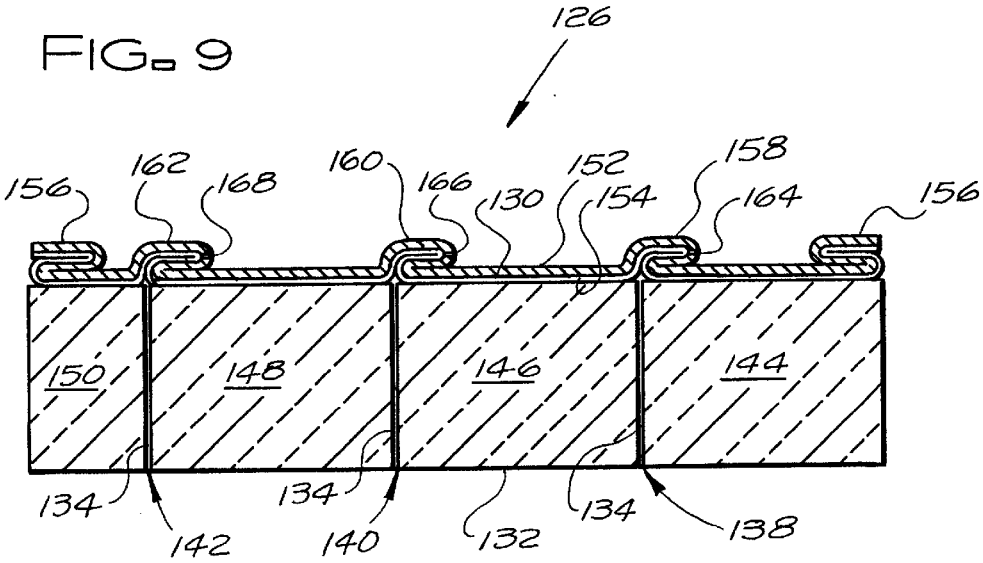
FIG. 9 is a schematic transverse cross section of a faced pre-cut resilient fibrous insulation blanket of the subject invention having cut and separable connector arrangements such as those shown in FIGS. 6 to 8.
Figure 10:
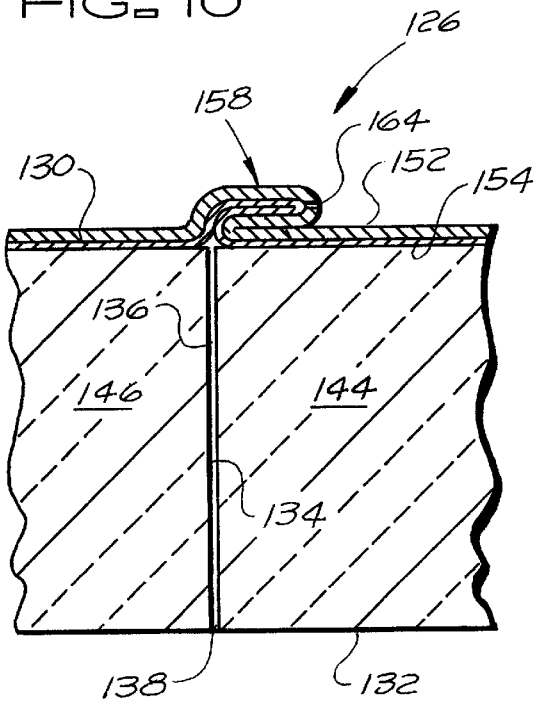
FIGS. 10 and 11 are partial schematic transverse cross sections through the faced pre-cut resilient fibrous insulation blanket of FIG. 9 to show adjacent sections of the pre-cut resilient fibrous insulation blanket being separated.
Figure 11:
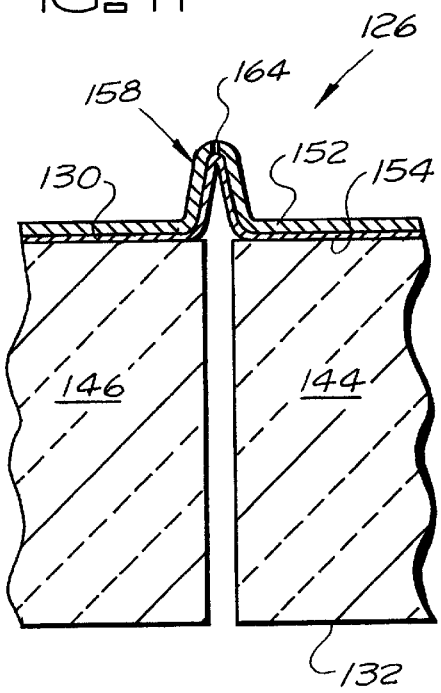

FIGS. 9 to 11 illustrate an embodiment 126 of the faced pre-cut resilient fibrous insulation blanket of the subject invention. As shown, the faced pre-cut resilient fibrous insulation blanket 126 has a first major surface 130 and a second major surface 132. There are three or more series of cuts 134 and separable connectors 136 (three series 138, 140 and 142 of cuts 134 and separable connectors 136 are shown) in the faced pre-cut resilient fibrous insulation blanket 126 that extend for the length of the faced pre-cut resilient fibrous insulation blanket. Each series of cuts 134 and separable connectors 134 divide the faced pre-cut resilient fibrous insulation blanket into blanket sections with the faced pre-cut resilient fibrous insulation blanket 126 being divided lengthwise into four or more blanket sections (four blanket sections 144, 146, 148 and 150 are shown) extending the length of the faced pre-cut resilient fibrous insulation blanket.

Each of the cuts 134 in each series of cuts and separable connectors 138, 140 and 142 extends from the first major surface 130 to the second major surface 132 of the pre-cut resilient fibrous insulation blanket and is separated from preceding and succeeding cuts 134 in its series of cuts and separable connectors by separable connectors 136. Each of the separable connectors 136 in each series of cuts and separable connectors 138, 140 and 142 may extend from the first major surface 130 to the second major surface 132 of the pre-cut resilient fibrous insulation blanket and is separated from preceding and succeeding separable connectors 136 in its series of cuts and separable connectors by cuts 134. While each of the separable connectors 136 may extend from the first major surface 130 to the second major surface 132 of the pre-cut resilient fibrous insulation blanket 126 as schematically shown in FIGS. 11 and 12, and, preferably, has a height greater than one half the thickness "T" of the pre-cut resilient fibrous insulation blanket, the connectors 136 may have a height less than one half the thickness of "T" of the pre-cut resilient fibrous insulation blankets. As an example of separable connectors that do not extend from the first major surface 130 to the second major surface 132 of the blanket, the separable connectors 136 might terminate short (e.g. about ⅛ of an inch to about ½ of an inch short) or either or both of the major surfaces 130 and 132. The lengths of the cuts 134 used and the heights and/or lengths of the separable connectors 136 used may vary with the integrity of the pre-cut resilient fibrous insulation blanket with the cuts being shorter and/or the separable connectors being greater in height and/or length for insulation blankets with less integrity.

The relative lengths of the cuts 134 and the separable connectors 136 are selected to ensure that the faced pre-cut resilient fibrous insulation blanket retains the required integrity for handling and to also ensure that the insulation blanket can be easily separated by hand at any of the series of cuts and separable connectors 138, 140 and 142 in the pre-cut resilient fibrous insulation blanket. Generally, the cuts 134 are each about 1 to about 5 inches long and the separable connectors 136 are each about ⅛ to about ½ of an inch long. For example, a typical series of cuts and separable connectors may have cuts about 1 to about ½ inches long and separable connectors about 3/16 to about ¼ of an inch long. The width of the cuts 134 forming the separable connectors 136 in both the faced and the unfaced embodiments of the pre-cut resilient fibrous insulation blanket of the subject invention is typically about four thousands of an inch wide when cut by a water jet and about one hundredth of an inch or less when cut with a compression cutter. The cuts 134 are formed in the pre-cut resilient fibrous insulation blanket so that the resilience of the blanket causes the cuts 134 in the pre-cut resilient fibrous insulation blanket 126 to close after the cuts are made in the blanket to prevent the formation of thermal bridges in the blanket in the direction of the thickness of the blanket.

The facing or facing sheet 152 typically overlies either the entire first major surface 130 or second major surface 132 of the pre-cut resilient fibrous insulation blanket 126 and is secured by a bonding agent 154 to the major surface of the pre-cut resilient fibrous insulation blanket that it overlies. As shown in FIG. 8, the facing sheet 152 has lateral tabs 156 and pairs of tabs 158, 160, and 162 adjacent each series of cuts and separable connectors 138, 140 and 142 in the faced pre-cut resilient fibrous insulation blanket 126 for stapling or otherwise securing the faced pre-cut resilient fibrous insulation blanket or section(s) of the faced pre-cut resilient fibrous insulation blanket to framing members. The lateral tabs 156, which are preferably formed by Z-shaped pleats in the facing sheet 152, extend for the length of the faced pre-cut resilient fibrous insulation blanket 126 and the pairs of tabs 158, 160 and 162 are longitudinally aligned with and extend for the lengths of the series of cuts and separable connectors 138, 140 and 142 of the faced pre-cut resilient fibrous insulation blanket 126. Preferably, each pair of tabs 158, 160 and 162 is formed by a Z-shaped pleat in the facing sheet with the tabs of each pair of tabs 158, 160 and 162 being separably connected to each other by perforated lines 164, 166 and 168 respectively, so that the facing can be separated at each series of cuts and separable connectors. With this structure, the faced pre-cut resilient fibrous insulation blanket 126, with the facing sheet 152, can be handled as a unit for insulating a cavity having a width about equal to the preselected width of the faced pre-cut resilient fibrous insulation blanket or easily separated or torn apart by hand into a reduced width resilient fibrous insulation blanket of one or more integral blanket sections by separating or tearing apart the faced pre-cut resilient fibrous insulation blanket 126 at one of the series of cuts and separable connectors e.g. series 138 as shown in FIGS. 10 and 11, and one of the perforated lines in the facing sheet 152, e.g. perforated line 164 as shown in FIGS. 10 and 11, for insulating a cavity having a lesser cavity width, e.g. less than a standard cavity width.

The spaced apart perforations of the perforated lines 164, 166 and 168 may be of various shapes, including but not limited to, round, oval, elongated, slit shaped, etc. and the spacing between perforations and the length of the perforations may vary as long as the facing is easily separated by hand along the line formed by the perforations. Preferably, the perforations of the perforated lines 164, 166 and 168 in the embodiment of FIGS. 9 to 11, are filled, e.g. with the bonding agent 154 that bonds the facing sheet 152 to one of the major surfaces of the faced pre-cut resilient fibrous insulation blanket or a similar material, to close the perforations so that the facing sheet 12 functions as a vapor retarder or barrier. While, perforations are preferred, tear strings could be used with or substituted for the perforated lines 164, 166 and 168. The tear strings would have a free end for gripping; be bonded to the facing sheet by the bonding agent 154; and would extend along lines that coincide with the locations of the perforated lines 164, 166 and 168.

The use of pairs of tabs 158, 160 and 162 formed by Z-shaped pleats in the facing sheet 152 wherein the tabs of each pair of tabs are separably bonded together by the bonding agent 154 bonding the facing sheet 152 to a major surface of the faced pre-cut resilient fibrous insulation blanket provides several advantages. The overlapping and bonding together of the tabs across their widths in each pair of tabs with the perforations of the perforated lines at the juncture of the tabs improves the vapor barrier properties of the perforated facings. There is less of a tendency for the facing sheet 152 to split during installation of the blanket because the bonding agent 154 joining the tabs of each pair of tabs together can yield when the faced pre-cut resilient fibrous insulation blanket is flexed. Locating the perforations along folds in the Z-shaped pleated, facilitates the tearing of the facing sheet 152 along the perforated lines and helps to prevent the propagation of the tears out of the tabs. As shown in FIG. 11, as the blanket sections adjacent a pair of tabs are separated, the tabs, which initially lie on a major surface of the blanket, are pulled away from the major surface of the blanket to extend generally perpendicular to the major surface of the blanket for better grasping by a worker as the tabs peel away from each other and finally separate from each other along the perforated line. In addition, the use of a facing with tabs adjacent each series of cuts and separable connectors between blanket sections, in this and other faced embodiments of the pre-cut resilient fibrous insulation blanket, not only provides tabs for securing the blanket sections in place, but also enables the facings to provide vapor barriers across the entire width of the blanket sections even when the means for separating the facing along each series of cuts and separable connectors, e.g. perforated lines, are not properly aligned with each series of cuts and separable connectors.

The integral tabs adjacent each series of cuts and separable connectors plus lateral tabs, such as the lateral tabs 156 shown in FIG. 9, can be used to secure the faced pre-cut resilient fibrous insulation blankets 126 or blanket sections of the faced pre-cut resilient fibrous insulation blanket 126 to framing members by stapling or other conventional means, either as a unit or as one or more blanket sections when one or more integral blanket sections are separated from the remainder of the pre-cut resilient fibrous insulation blanket. Preferably, the tabs are about one half to about one and one half inches in width. When securing the faced pre-cut resilient fibrous insulation blanket 126 or one or more blanket sections of the faced pre-cut resilient fibrous insulation blanket to framing members, the tabs adjacent the series of cuts and separable connectors and the lateral tabs used to secure the blanket in place are at least partially unfolded and extended outward from the faced pre-cut resilient fibrous insulation blanket or blanket sections of the faced pre-cut resilient fibrous insulation blanket prior to stapling or otherwise securing the tabs to the framing members.

While the separable connectors, which can be separated by hand without the need to use a cutting tool, and the facing of FIGS. 6 to 11 are preferred, other separable connectors which can be separated by hand without the need to use a cutting tool and facings may be used in the resilient pre-cut resilient fibrous insulation blanket of the subject invention. For example, as shown in FIGS. 2 to 6 of U.S. Pat. No. 6,083,594, the separable connectors between blanket sections may be formed along a major surface of the blanket by longitudinal cuts passing part of the way through the blanket from the opposite major surface of the blanket and leaving a portion of the blanket uncut adjacent the major surface to form the separable connectors. While not preferred, facings without tabs intermediate the blanket sections may be used such as the facing of FIGS. 4 to 6 of U.S. Pat. No. 6,083,594, the disclosure of which is incorporated herein in its entirety by reference. Separable connectors, extending the length of the blanket, can also be formed by cutting the blanket longitudinally along both major surfaces of the blanket to form pairs of laterally aligned or substantially aligned cuts extending inward from each major surface of the blanket that leave a portion of the blanket intermediate the cuts and the major surfaces of the blanket uncut to form separable connectors. Separable connectors may also be formed by longitudinally cutting a resilient, fibrous insulation blanket into separate blanket sections and, subsequently, separably connecting the separate blanket sections together with an adhesive or bonding agent to form a blanket of separable blanket sections. A blanket with separable blanket sections may also be formed by longitudinally cutting a resilient fibrous insulation blanket into separate blanket sections and, subsequently, separably connecting the separate blanket sections together with sheets overlaying one or both major surfaces of the blanket sections and bonded to the blanket sections or strips overlaying the cuts between the blanket sections and bonded to the major surfaces of the blanket sections adjacent the cuts. The sheets would have a tear strength, at the cuts in the blanket between adjacent blanket sections, either through a low tear strength of the sheet material or through the provision of perforated lines in the sheet material along the cuts, that would permit the blanket sections to be separated from each other along the cuts in the blanket without the need to use a cutting tool. Other facings that could be used including facings made up of a series of sheets that have overlapping lateral edge portions extending the length of the blanket with the overlapping edge portions of successive sheets, overlapping at the longitudinally extending separable connectors joining adjacent blanket sections of the pre-cut resilient fibrous insulation blanket together, to form pairs of overlapping tabs at the separable connectors.

In describing the invention, certain embodiments have been used to illustrate the invention and the practices thereof. However, the invention is not limited to these specific embodiments as other embodiments and modifications within the spirit of the invention will readily occur to those skilled in the art on reading this specification. Thus, the invention is not intended to be limited to the specific embodiments disclosed, but is to be limited only by the claims appended hereto.

What is claimed is:

1. A method of making a pre-cut resilient fibrous insulation blanket having first and second longitudinally extending lateral blanket sections, where the second lateral blanket section is greater in width than the first lateral blanket section, and a plurality of longitudinally extending intermediate blanket sections wherein the intermediate blanket sections are of substantially equal width with respect to each other, comprising:

providing a resilient fibrous insulation blanket having a width W; the fibrous insulation blanket being laterally compressible at least 0.75 inches;

selecting a width $L_1$ for the first lateral blanket section to be formed in the fibrous insulation blanket;

selecting the number of sections N to be formed in the fibrous insulation blanket where N is 4 or greater;

using the formulas $W=L_1+L_2+(N-2)A$; $A=(L_2-L_1)2$; and $I=L_2-L_1$ where $L_2$ is the width of the second lateral blanket section; A is the width of each intermediate blanket section; and I is the difference in width between the lateral blanket sections; determine the value of I;

substituting the value I for $(L_2-L_1)$ in the equation $A=(L_2-L_1)2$; determine for the value of A;

substituting the value for A in the equation $A=(L_2-L_1)2$; determine the value of $L_2$ whereby the widths $L_1$ of the first lateral blanket section, $L_2$ of the second lateral blanket section, and A of each of the intermediate blanket sections are known; and form a plurality of longitudinally extending cut and separable connector means in the resilient insulation blanket in accordance with the widths of the lateral blanket sections and intermediate blanket sections determined above to form the blanket sections in the resilient fibrous insulation blanket with cuts of the cut and separable connector means being closed to prevent a formation of thermal bridges in the direction of the thickness of the resilient fibrous insulation blanket and separable connectors of the cut and separable connector means separably joining adjacent blanket sections of the blanket sections along the length of the resilient fibrous insulation blanket to hold the resilient fibrous insulation blanket together for handling while being separable by hand to permit separation of the adjacent blanket sections whereby the resilient fibrous insulation blanket can be handled as a unit or selectively separated by hand at any of the cut and separable connector means to form a reduced width resilient fibrous insulation blanket.

2. The method according to claim 1 wherein:

the distance $L_1$ is a distance the fibrous material can be compressed laterally without appreciably adversely affecting the thermal performance of the resilient fibrous insulation blanket in a direction of the thickness of the resilient fibrous insulation blanket.

3. The method according to claim 2 wherein:

the distance $L_1$ is a distance the fibrous material can be compressed laterally without appreciably adversely affecting the resilience of the resilient fibrous insulation blanket or blanket sections in a direction of the width of the resilient fibrous insulation blanket.

4. The method according to claim 1 wherein:

the distance $L_1$ is a distance the fibrous material can be compressed laterally without appreciably adversely affecting the resilience of the resilient fibrous insulation blanket or blanket sections in a direction of the width of the resilient fibrous insulation blanket.

5. A method of making a pre-cut resilient fibrous insulation blanket having a first longitudinally extending lateral blanket sections and a plurality of additional longitudinally extending blanket sections, including a second longitudinally extending lateral blanket section, wherein the additional blanket sections, including the second lateral blanket section, are of substantially equal width with respect to each other, comprising:

providing a resilient fibrous insulation blanket having a length, a width W and a thickness; the fibrous material of the resilient fibrous insulation blanket being laterally compressible at least a distance D of 0.75 inches;

determine the distance D for the fibrous material of the resilient fibrous insulation blanket;

divide the distance D into the width W of the resilient fibrous insulation blanket to obtain a number;

round the number up to the nearest higher odd integer and divide the nearest higher odd integer into the width W of the resilient fibrous insulation blanket to obtain a first possible width for the lateral blanket section of the resilient fibrous insulation blanket that is less than distance D; multiply the first possible width for the lateral blanket section by 2 to obtain a first possible width for each of the additional blanket sections of the resilient fibrous insulation blanket;

round the number down to the nearest lower odd integer and divide the nearest lower odd integer into the width W of the resilient fibrous insulation blanket to obtain a second possible width for a the lateral blanket section of the resilient fibrous insulation blanket that is greater than the distance D; multiply the second possible width for the lateral blanket section by 2 to obtain a second possible width for each of the additional blanket sections of the resilient fibrous insulation blanket;

compare the first possible widths for the blanket sections with the second possible widths for the blanket sections and select one set of possible widths for the blanket sections; and form a plurality of longitudinally extending cut and separable connector means in the resilient insulation blanket in accordance with the selected set of widths for the blanket sections to form the blanket sections in the resilient fibrous insulation blanket with the cut and separable connector means separably joining adjacent blanket sections of the blanket sections along the length of the resilient fibrous insulation blanket to hold the resilient fibrous insulation blanket together for handling while being separable by hand to permit separation of the adjacent blanket sections whereby the resilient fibrous insulation blanket can be handled as a unit or selectively separated by hand at any of the cut and separable connector means to form a reduced width resilient fibrous insulation blanket.

6. The method according to claim 5 wherein:

the distance D is a distance the fibrous material can be compressed laterally without appreciably adversely affecting the thermal performance of the resilient fibrous insulation blanket in a direction of the thickness of the resilient fibrous insulation blanket.

7. The method according to claim 6 wherein:

the distance D is a distance the fibrous material can be compressed laterally without appreciably adversely affecting the resilience of the resilient fibrous insulation blanket or the blanket sections in a direction of the width of the resilient fibrous insulation blanket.

8. The method according to claim 5 wherein:

the distance D is a distance the fibrous material can be compressed laterally without appreciably adversely affecting the resilience of the resilient fibrous insulation blanket or the blanket sections in a direction of the width of the resilient fibrous insulation blanket.

* * * * *